US008726780B2

(12) United States Patent
White et al.

(10) Patent No.: US 8,726,780 B2
(45) Date of Patent: May 20, 2014

(54) BARRIER

(75) Inventors: William Collins White, Cicero, NY (US); John P. Paraschos, Nedrow, NY (US); John Kleniatis, Jamesville, NY (US)

(73) Assignee: Defenshield, Inc., East Syracuse, NY (US)

( * ) Notice: Subject to any disclaimer, the term of this patent is extended or adjusted under 35 U.S.C. 154(b) by 39 days.

(21) Appl. No.: 13/475,001

(22) Filed: May 18, 2012

(65) Prior Publication Data

US 2012/0291619 A1 Nov. 22, 2012

Related U.S. Application Data

(60) Provisional application No. 61/487,496, filed on May 18, 2011.

(51) Int. Cl.
*F41H 5/24* (2006.01)

(52) U.S. Cl.
USPC ..... 89/36.04; 89/36.07; 89/920

(58) Field of Classification Search
USPC ..... 89/36.04, 36.07, 36.08, 36.09, 36.14; 52/79.9, 169.6, 171.1, 478, 519, 531, 52/579; 109/78, 80, 85; D25/58
See application file for complete search history.

(56) References Cited

U.S. PATENT DOCUMENTS

| | | | | |
|---|---|---|---|---|
| 4,001,987 | A * | 1/1977 | Coulthard | 52/79.9 |
| 7,490,539 | B2 * | 2/2009 | Ma | 89/36.02 |
| D672,474 | S * | 12/2012 | White et al. | D25/58 |
| 2005/0235819 | A1 * | 10/2005 | Long | 89/36.07 |
| 2007/0012168 | A1 * | 1/2007 | Weatherwax | 89/36.04 |
| 2007/0180982 | A1 * | 8/2007 | Dagher et al. | 89/36.02 |
| 2009/0282749 | A1 * | 11/2009 | Warminsky | 52/79.1 |
| 2010/0043629 | A1 * | 2/2010 | Carberry et al. | 89/36.02 |
| 2010/0089229 | A1 * | 4/2010 | Ackerman et al. | 89/36.04 |
| 2011/0023759 | A1 * | 2/2011 | Waller | 109/79 |
| 2011/0232543 | A1 * | 9/2011 | Burroughs et al. | 109/79 |
| 2012/0168702 | A1 * | 7/2012 | Fromm | 256/13.1 |

* cited by examiner

*Primary Examiner* — Bret Hayes
(74) *Attorney, Agent, or Firm* — David L. Nocilly; Bond Schoeneck & King, PLLC

(57) ABSTRACT

A barrier formed from a plurality of identical modular units that have an essentially planar front panel and triangular shaped top and bottom plates extending rearward from the front panel. Adjacent units are interconnected to one another at their terminal vertices by a square tubular member. A square shaped opening is formed approximately centrally through each of the triangular shaped plates. In addition, elongated linkages may be provided at about the midpoint of each side edge for purposes of interconnecting units that are positioned adjacent to another unit so as to assist in the formation of the overall barrier. The linkages provide pivotal movement between adjacent barriers through a range of angles from about 90 degrees (to provide a corner arrangement) to 180 degrees (to provide a straight wall arrangement).

14 Claims, 11 Drawing Sheets

BARRIER

CROSS-REFERENCE TO RELATED APPLICATIONS

The present application claims priority to U.S. Provisional Application No. 61/487,496 filed on May 18, 2011.

BACKGROUND OF THE INVENTION

1. Field of the Invention

The present invention relates generally to barriers, and more specifically to barriers comprising modular units of ballistic proof material.

2. Description of the Related Art

In military and para-military operations, there is often a need for barriers to be erected behind which personnel can position themselves for protection from ballistics, explosives, or other harmful projectiles. Historically, soldiers would dig fox holes or trenches, or utilize natural bunkers as protection against enemy fire. In certain geographic regions, natural formations may not exist, and it may not be practicable or suitable to utilize trenches or fox holes for adequate protection.

BRIEF SUMMARY OF THE INVENTION

It is therefore a principal object of the present invention to provide a barrier that may be built using modular units, each of which is man-portable.

It is another object of the invention to provide a barrier that may be formed in a variety of orientations.

Other objects and advantages of the present invention will in part be obvious and in part appear hereinafter.

In accordance with the foregoing objects and advantages, the present invention provides a barrier comprising a plurality of modular units, each of which is identical to the others. Each unit is composed of a ballistic proof material and comprises an essentially planar front panel and triangular shaped top and bottom plates extending rearward from the front panel and interconnected to one another at their terminal vertices by a square tubular member. A square shaped opening is formed approximately centrally through each of the triangular shaped plates. In addition, elongated linkages are provided at about the midpoint of each side edge for purposes of interconnecting units that are positioned adjacent to another unit so as to assist in the formation of the overall barrier. The linkages provide pivotal movement between adjacent barriers through a range of angles of essentially 90 degrees (which would provide for a square relationship between adjacent panels) to 180 degrees (which would provide for a straight wall type panel arrangement).

In addition to modular units that simply comprise front panels of ballistic proof material, additional modular units of the same basic construction are provided, but with windows (also composed of ballistic proof material), or movable covers for an aperture, also composed of ballistic proof material. The windows may be utilized when having a direct line of sight through the barrier is desired, and a unit with the movable cover for an aperture is utilized for providing access for a gun barrel or other weapon when desired.

Due to the symmetric and modular nature of the individual units, they may be assembled in any variety of shapes, including a planar barrier, a circular housing barrier, a curved barrier, or any other shape desired. In addition, each unit is sized (overall dimensions and weight) to make it man-portable according to military standards. The present invention may be used to replace sandbag bunkers, earth filled barriers, brick and mortar guard houses or checkpoints.

BRIEF DESCRIPTION OF THE SEVERAL VIEWS OF THE DRAWING(S)

The present invention will be more fully understood and appreciated by reading the following Detailed Description in conjunction with the accompanying drawings, in which.

DETAILED DESCRIPTION OF THE INVENTION

Figure 1:
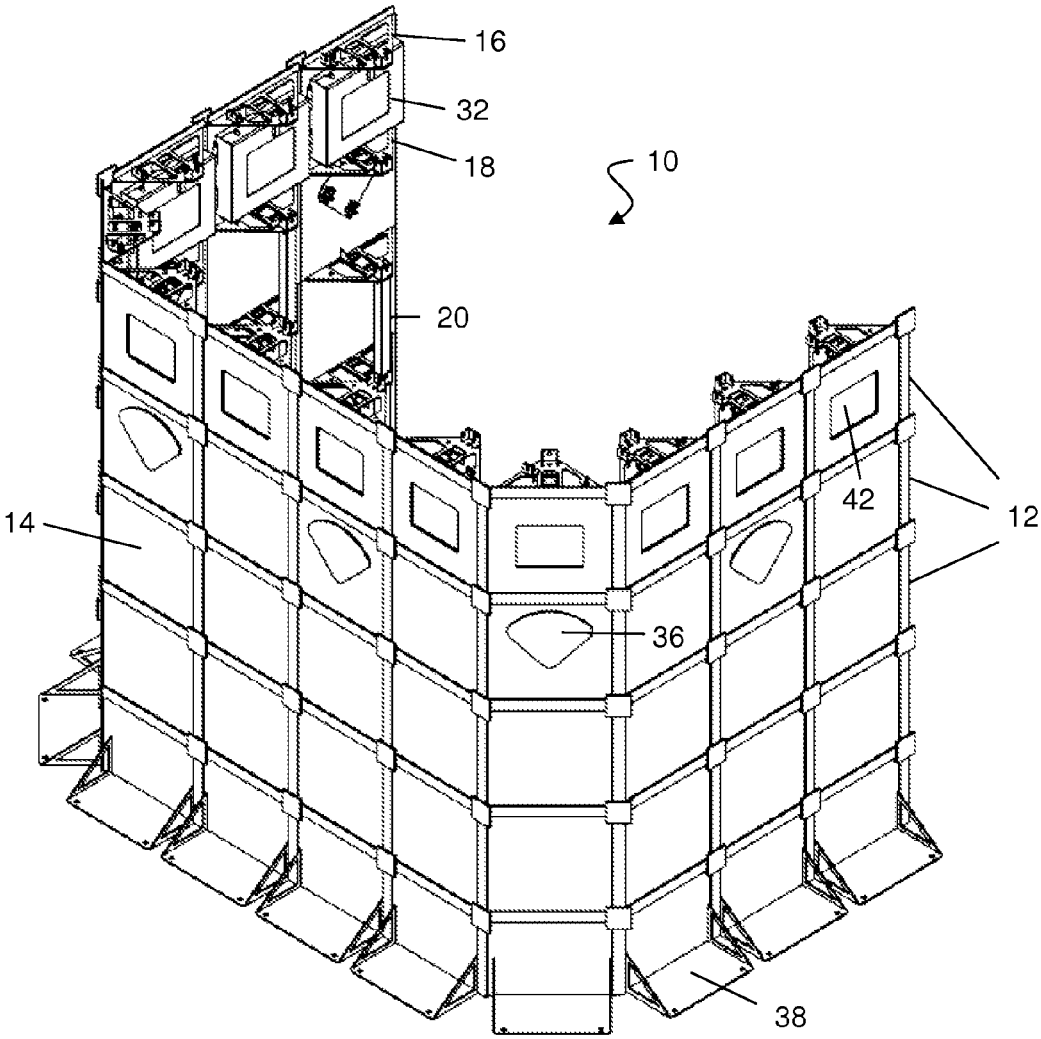
FIG. 1 is a front perspective view of a barrier composed of individual modular units in accordance with the present invention.
Figure 2:
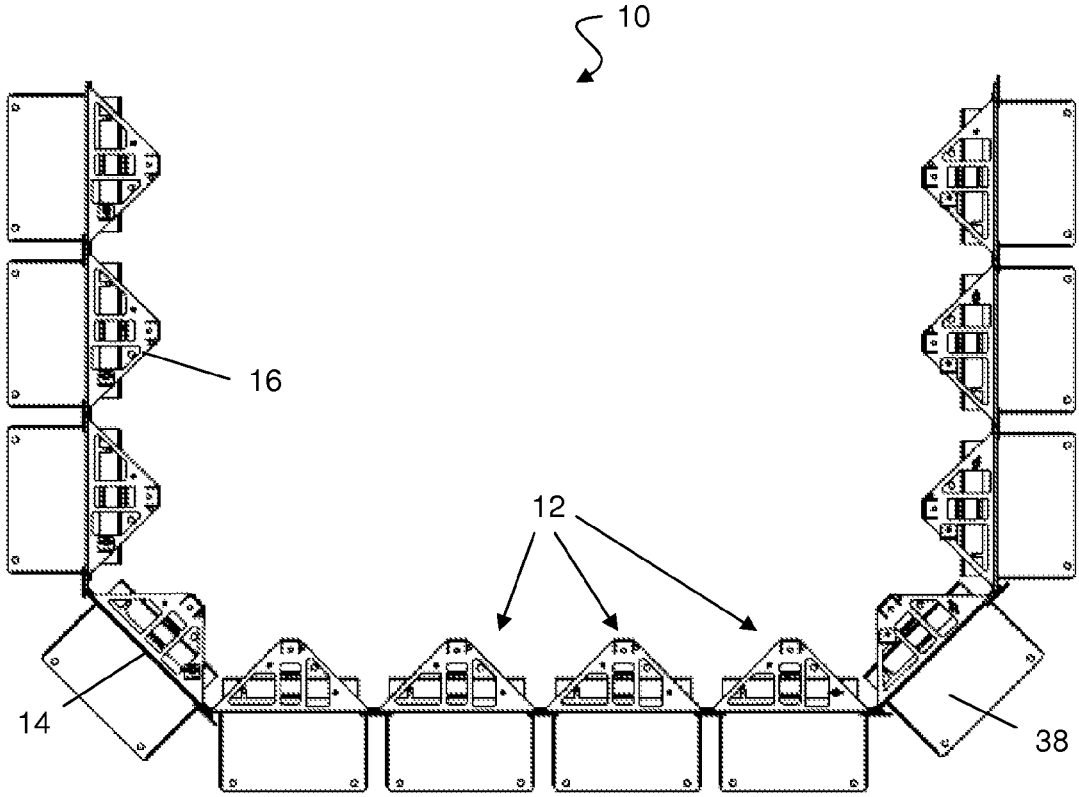
FIG. 2 is a top plan view thereof.

Referring now to the drawings, wherein like reference numerals refer to like parts throughout, there is seen in FIG. 1 a barrier, designated generally by reference numeral 10, comprising a plurality of individual modular units 12 interconnected to one another to form the barrier. Each unit 12 is composed of a ballistic proof material and is sized in dimension and weight to be man-portable according to military standards. It is a feature of the present invention that a battalion, squadron, or other grouping of personnel, each of whom can carry one unit 12, can assemble barrier quickly and in any shape desired (i.e., form barrier 10 in an essentially planar wall formation, in a circular fashion, in a curved formation, etc.). Referring to FIG. 2, units 12 may be interconnected to each other and capable of pivotal movement through a range of angles from about 90 degrees (to provide a corner arrangement) to 180 degrees (to provide a straight wall arrangement).

Figure 3:
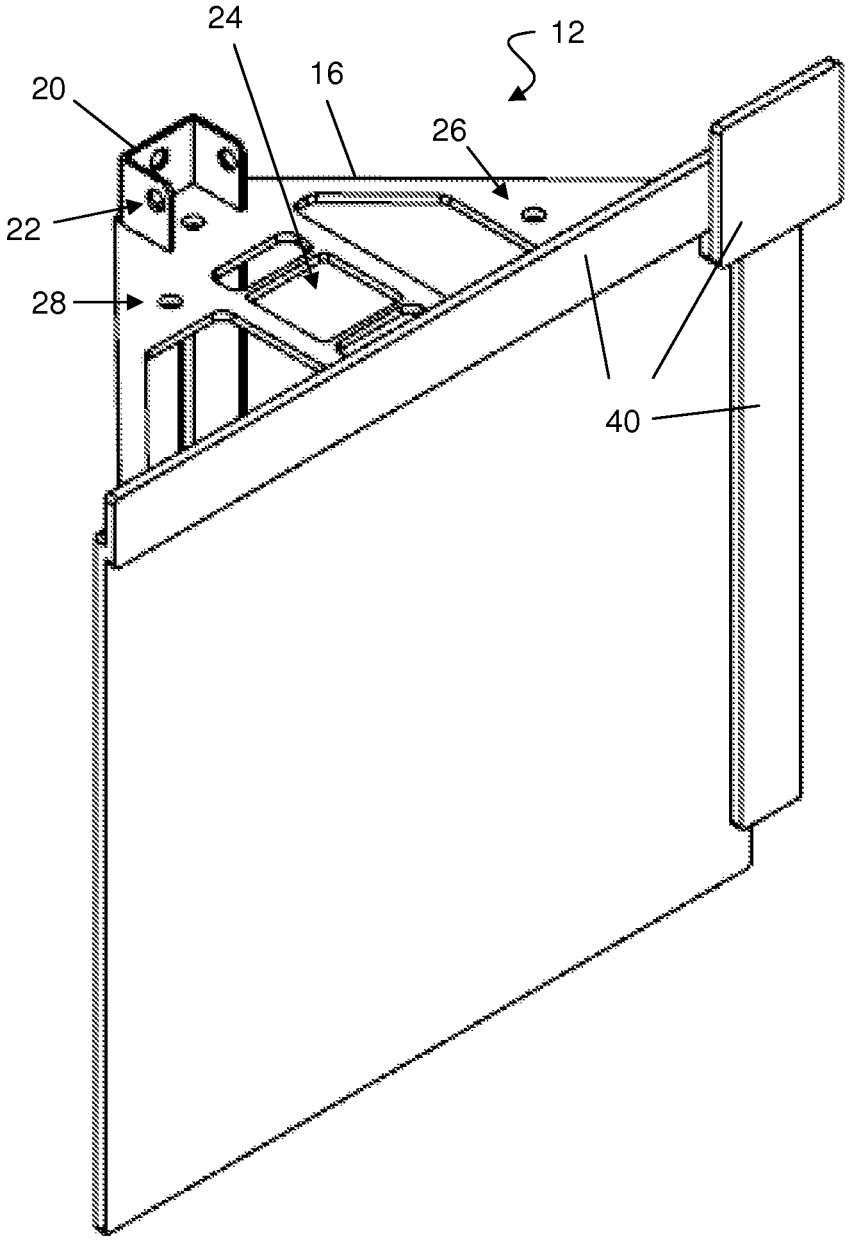
FIG. 3 is front perspective view of an individual modular unit in accordance with the present invention.
Figure 4:
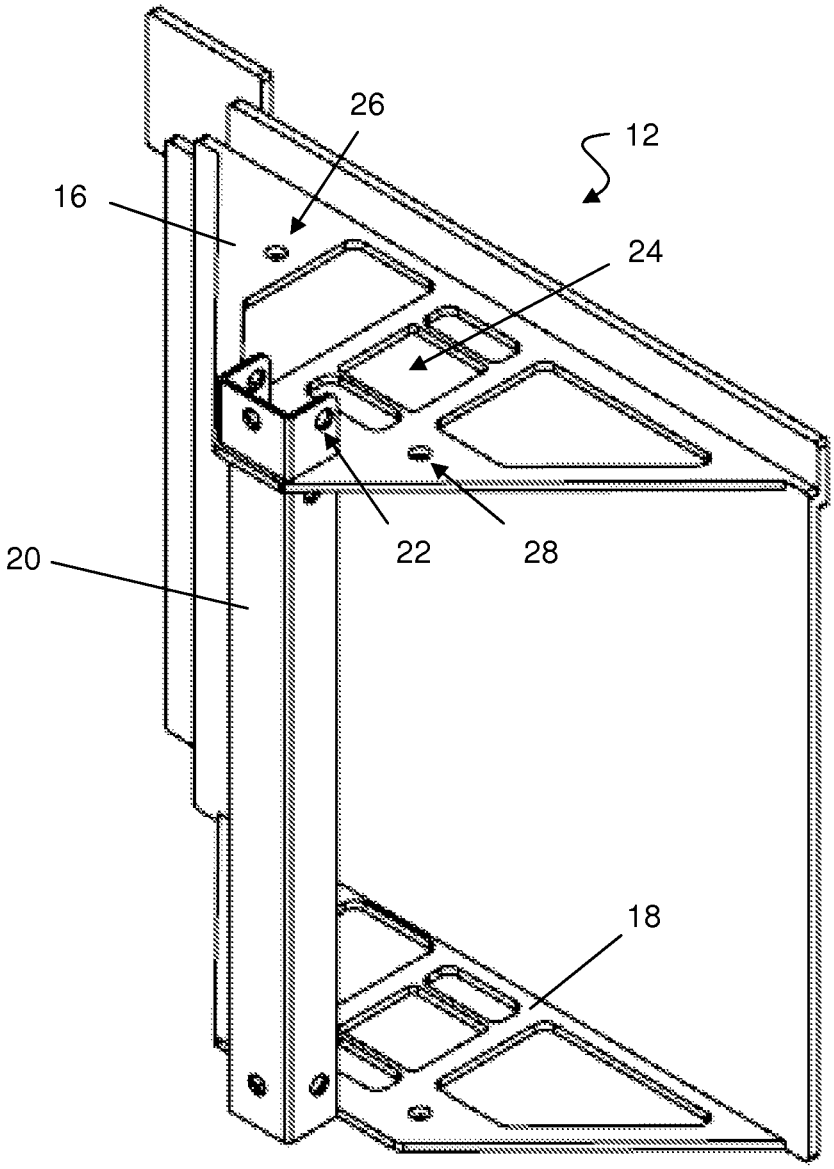
FIG. 4 is a rearward perspective of an individual modular unit in accordance with the present invention.

Referring to FIGS. 3 and 4, each modular unit 12 is composed of ballistic proof material and comprises an essentially planar front panel 14, top and bottom triangular shaped plates 16, 18 that each share a common edge with and extend rearward from the front panel 14 in perpendicular planes thereto (and in spaced, parallel planes to one another), and a tubular member 20 that extends between and interconnects top and bottom plates 16 and 18 at their respective, outwardly positioned vertices. Tubular member 20 is square in cross-section and includes a plurality of holes 22 formed through each surface, with each set of holes 22 on opposing sides being diametrically aligned with one another. In addition, the tubular nature of member 20 extends fully through plates 16 and 18, thereby providing a tubular passage therethrough which can be used for any desired purpose. It should be recognized by those of skill in art that member 20 does not have to be square tubular, or even fully tubular. Instead, member 20 need merely allow for interconnection to a vertically adjacent member 20. Preferably, the upper portion of member 20 and the lower portion of member 20 are dimensioned such that one will fit inside the other, with holes 22 in the upper portion of one unit 12 aligning with the lower portion of another unit 12 positioned thereon, thereby allowing units 12 to be interconnected to each other and held together via any conventional fastener, such as a bolt or pin, inserted through the aligned holes 22 of stacked units 12. Alternatively, member 20 may be formed from separate upper and lower sections for interconnecting to vertically adjacent units 12, such as that seen in FIGS. 5-8 and described below, when panel 14 includes features whose use would be inhibited if member 20 extended entirely from top plate 16 to bottom plate 18.

Referring to FIGS. 3 and 4, plates 16 and 18 each include an essentially centrally located opening 24 formed therethrough that can be used for any desired purpose, such as to hold elongated items. In addition, each plate 16 and 18 includes a first opening 26 formed adjacent one rearward extending edge and adjacent to front panel 12, and a second opening 28 formed adjacent the opposite rearward extending edge and adjacent to tubular member 20. As further seen in FIGS. 3 and 4, one of the upper or lower edges of front panel 14 and one of the side edges of front panel 14 may include one or more overlapping plates 40 that are spaced apart from panel 14 by an integrally formed shoulder 42 so that plates 40 that extends in a plane parallel to panel 14 for the purposes of overlapping the front panel 14 of an adjacent unit 14 when units 12 are assembled into barrier 10.

Figure 5:
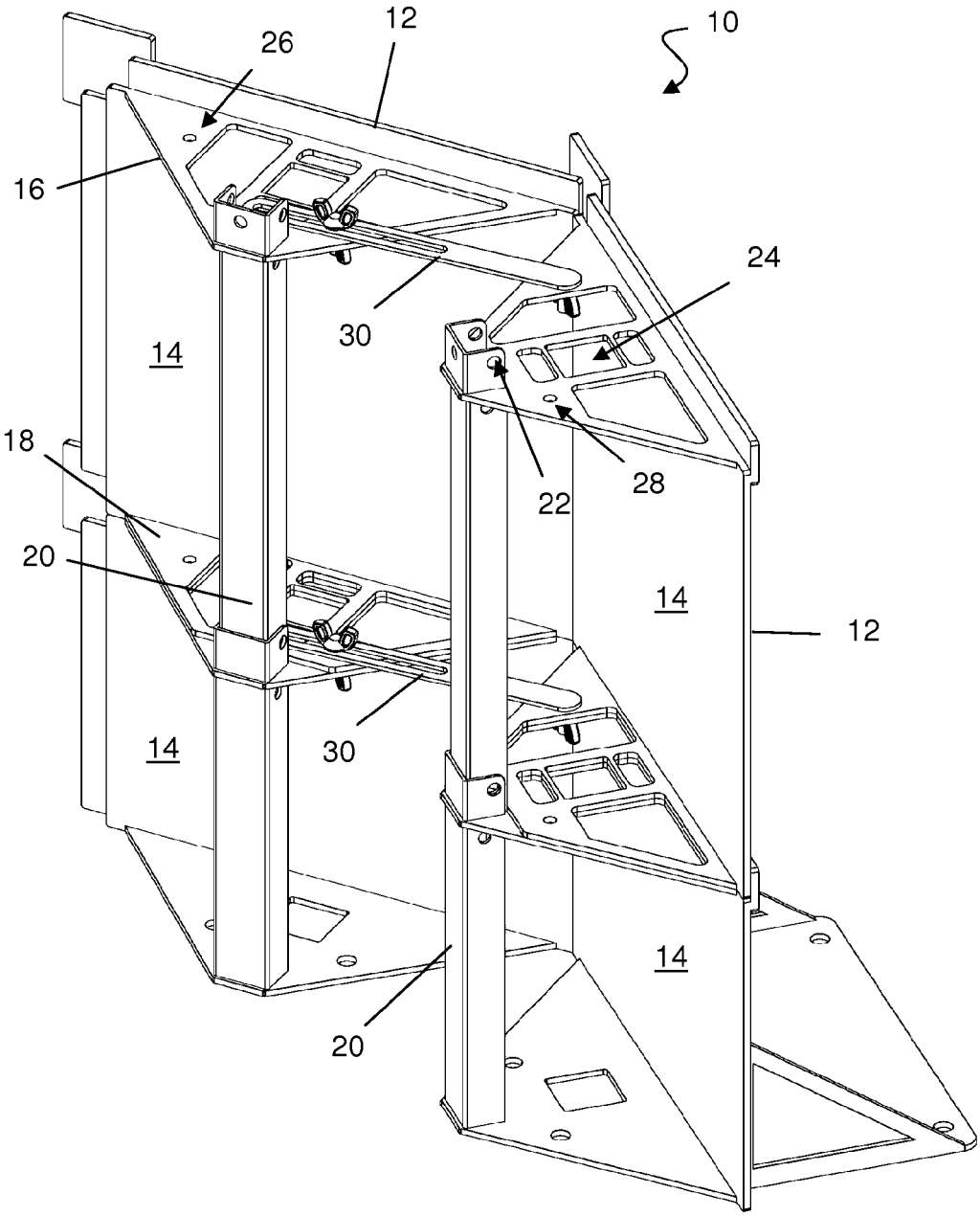
FIG. 5 is a rear perspective view of a portion of a barrier composed of individual modular units in accordance with the present invention.

Referring to FIG. 5, when assembling barrier 10, adjacent units may optionally be interconnected by linkages 30 that are fastened between opening 26 on one unit 12 and opening 28 on the laterally adjacent unit 12. Linkages 30 permit pivotal movement of one unit 12 relative to its laterally adjacent unit 12, thereby permitting barrier 10 to be formed in any desired shape, including a planar wall structure, a curved barrier structure, or even a fully enclosed barrier (where all personnel would be fully enclosed on all sides by the barrier).

Figure 6:
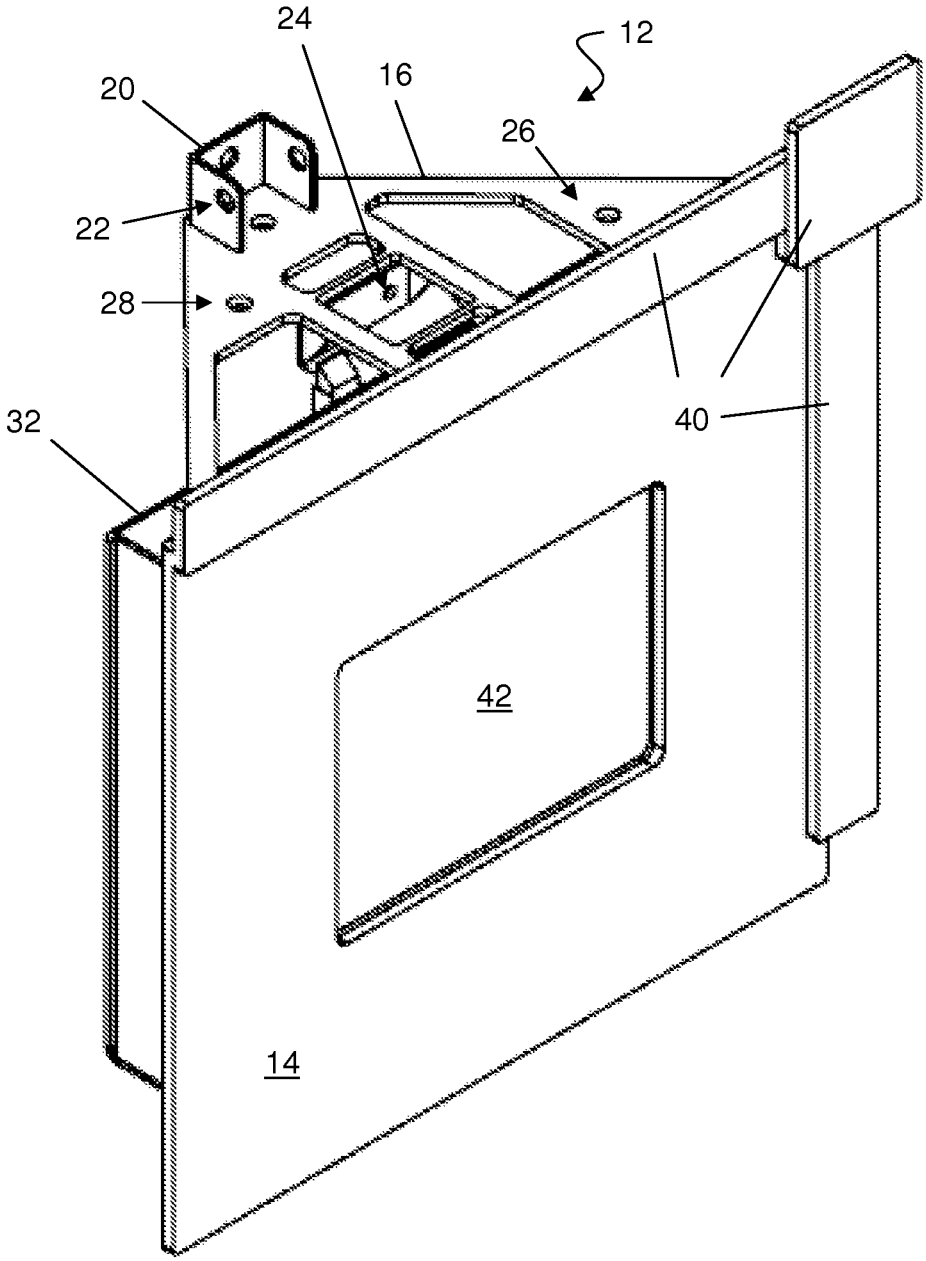
FIG. 6 is front perspective view of a first alternative embodiment of an individual modular unit in accordance with the present invention.
Figure 7:
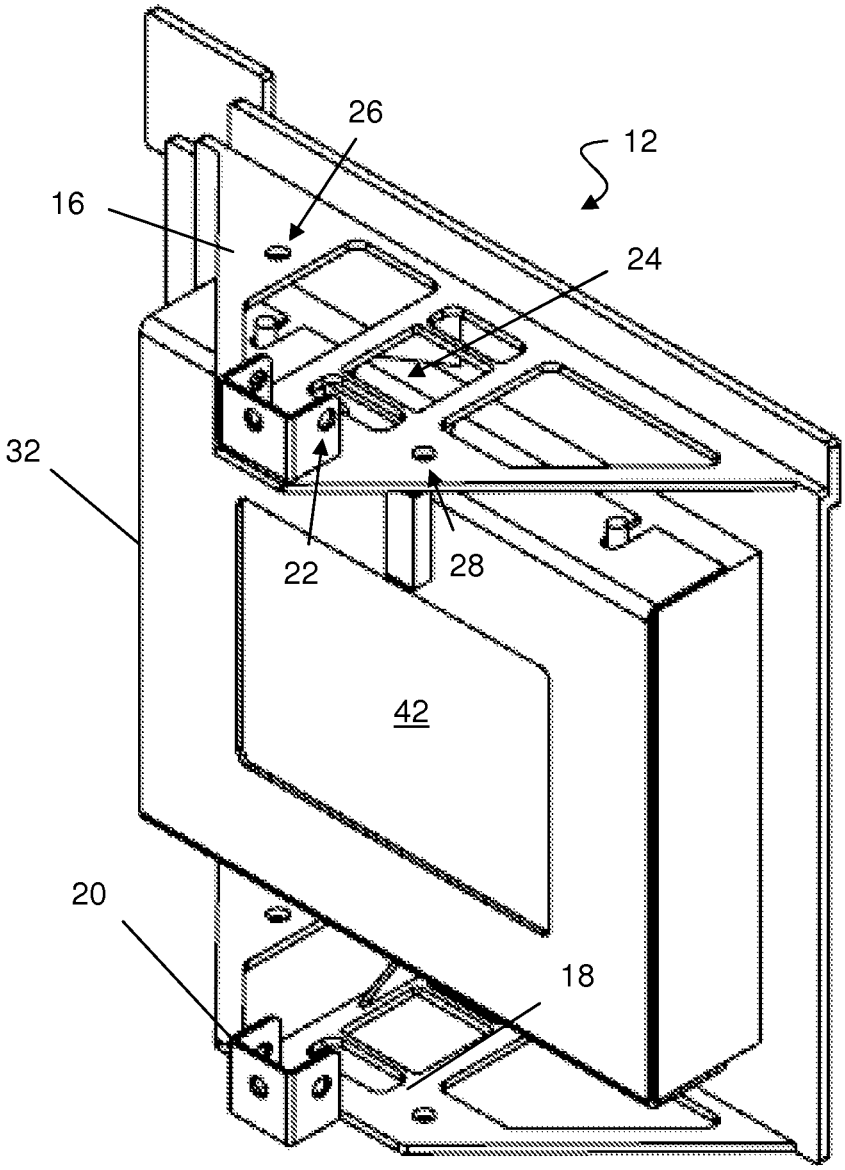
FIG. 7 is a rearward perspective of a first alternative embodiment of an individual modular unit in accordance with the present invention
Figure 8:
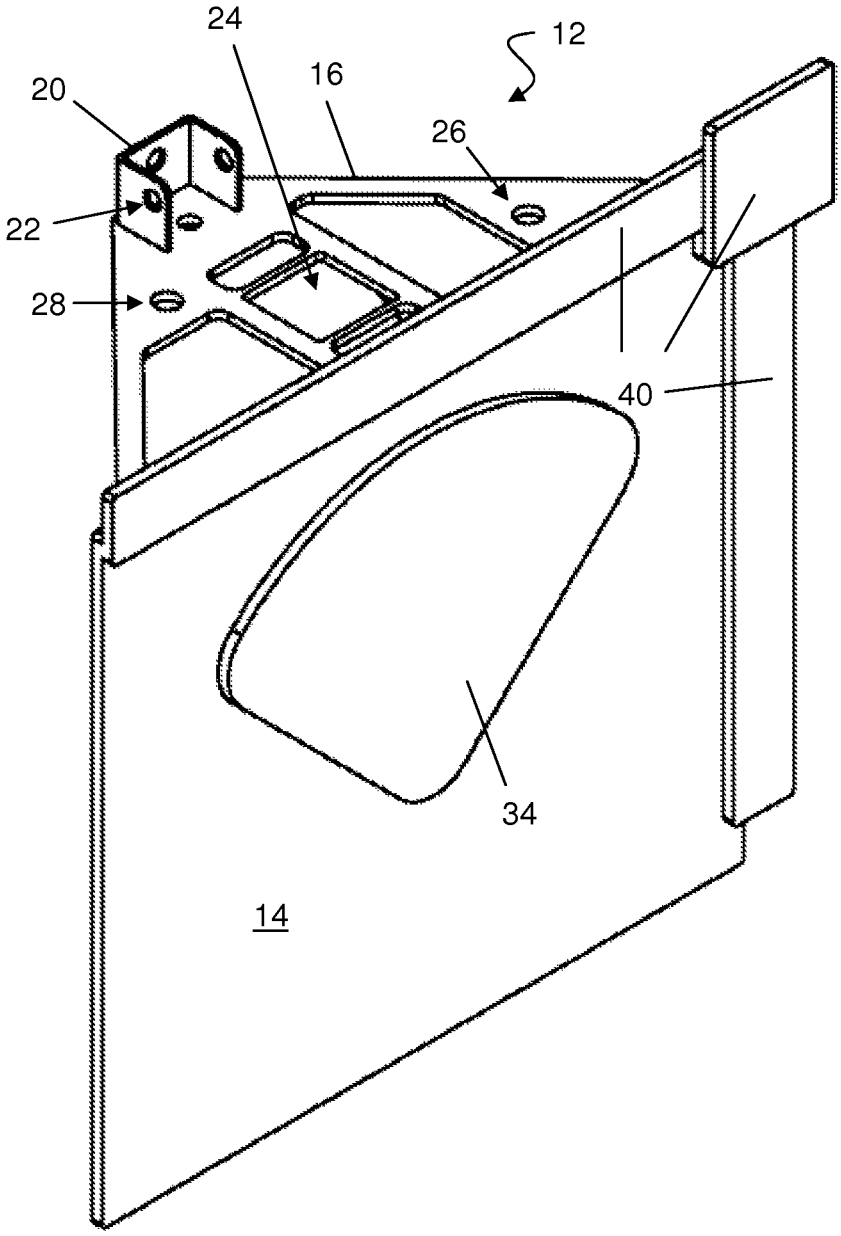
FIG. 8 is front perspective view of a second alternative embodiment of an individual modular unit in accordance with the present invention.
Figure 9:
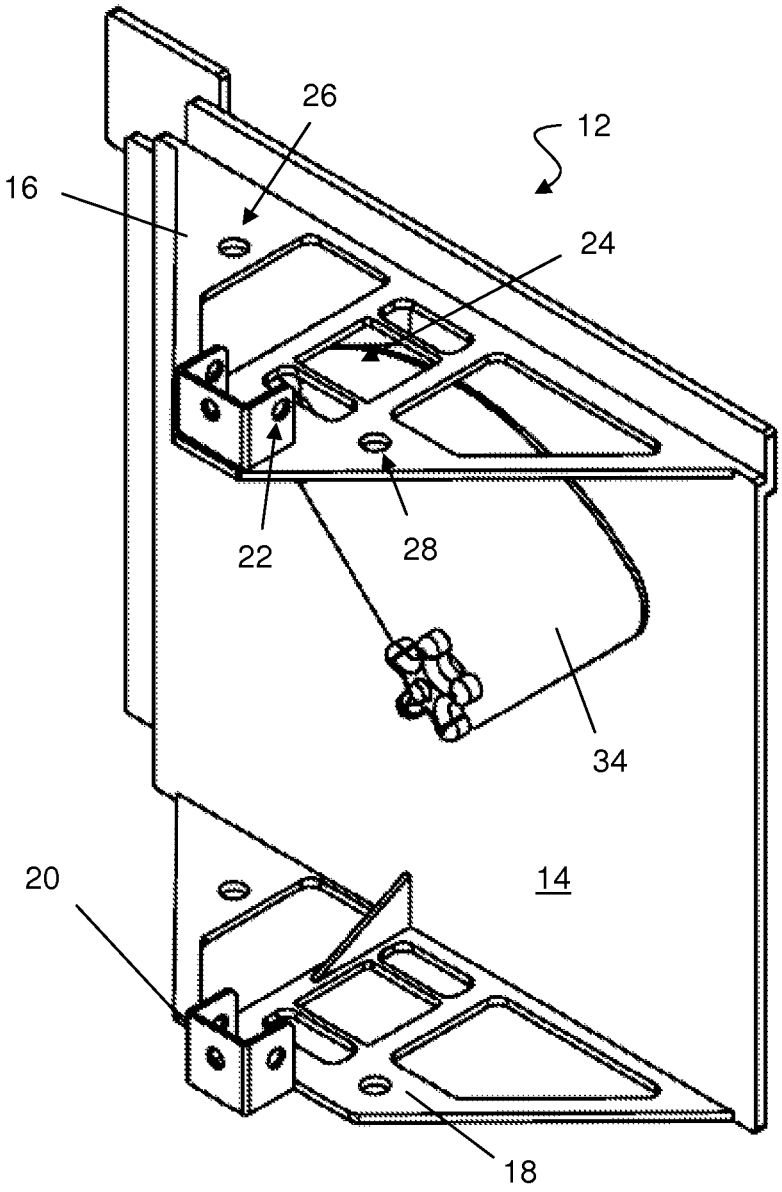
FIG. 9 is a rearward perspective of a second alternative embodiment of an individual modular unit in accordance with the present invention.
Figure 10:
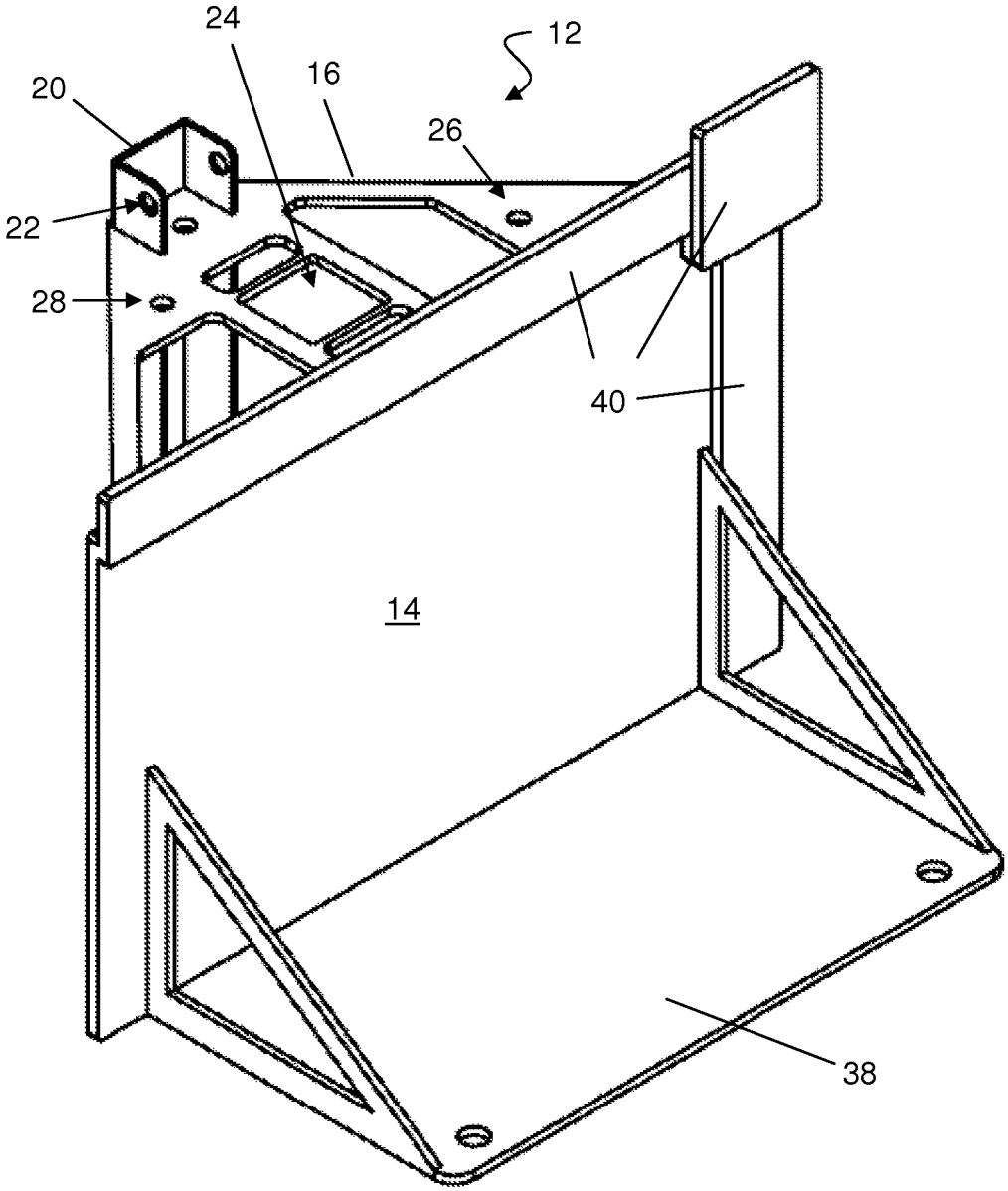
FIG. 10 is front perspective view of a third alternative embodiment of an individual modular unit in accordance with the present invention.
Figure 11:
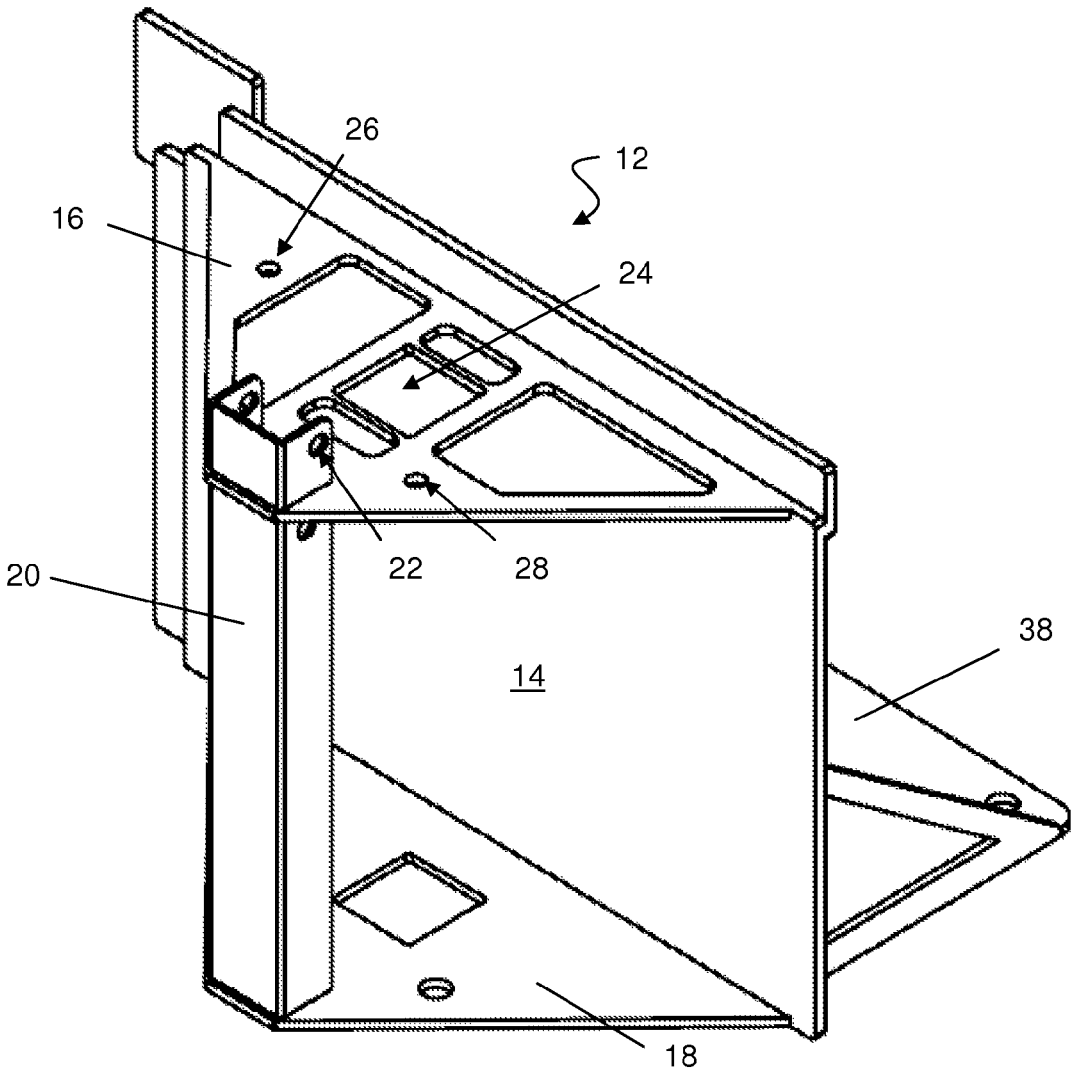
FIG. 11 is a rearward perspective of a fourth alternative embodiment of an individual modular unit in accordance with the present invention.

In addition to front panels 12 comprising a solid panel of ballistic proof/resistant material, alternative embodiments of the present invention may provide panels 12 that serve additional purposes. For example, as seen in FIGS. 6 and 7, panels 12 may include a pivotal window frame 32 containing a transparent portion 42 that is preferably composed of ballistic proof/resistant material for viewing or for permitting objects to be based through barrier 10. Alternatively, as seen in FIGS. 8 and 9, panels 12 may include a movable cover 34 composed of a ballistic proof/resistant material for selectively exposing or covering a gun port 36 through which a weapon can be pointed and discharged. In yet a further embodiment of the invention, as seen in FIGS. 10 and 11, some units 12 may include a platform 38 attached to the lower edge of panel 14 so that units 12 with platform 38 may be used as a more stable base for barrier 10. In yet another alternate embodiment of the present invention, panels 14 may includes slightly sloped front faces at both the top and bottom edges that provide a solid surface when barrier 10 is formed as a straight wall. It should be recognized by those of skill in the art that panels 14 may be provided with any number of features that are desirable or advantageous in a ballistic barrier. Thus configured, the present invention may be used to replace sandbag bunkers, earth filled barriers, brick and mortar guard houses or checkpoints.

What is claimed is:

1. A ballistic barrier, comprising:

a front panel defining a top edge, a bottom edge and two side edges;

opposing top and bottom panels extending from said top and bottom edges of said front panel, wherein each of said top and bottom panels include a first, wide end attached to said front panel and extends to a second, narrow end; and a tubular member having an upper portion and a lower portion, both of which include at least one hole formed transversely therethrough, wherein said upper and lower portions are spaced apart from said front panel and attached to said narrow, second ends of said top and bottom panels, respectively, and extend at least partially from said top panel to said bottom panel;

wherein said upper portion of said tubular member is dimensioned to telescopically engage with said lower portion of said tubular member such that said holes formed therethrough will be in alignment.

2. The barrier of claim 1, further comprising a first plate spaced apart from said first panel and extending from one of said top and bottom edges of said front panel.

3. The barrier of claim 2, further comprising a second plate spaced apart from said first panel and extending from one of said side edges of said front panel.

4. The barrier of claim 3, further comprising a linkage having a first end connected to said top panel and a second end adapted for slidingly engaging another said top panel of said second, adjacently positioned modular unit.

5. A modular ballistic barrier system, comprising:

a plurality of modular units positioned laterally and vertically adjacent to each other, wherein each unit includes a front panel defining a top edge, a bottom edge and two side edges; opposing top and bottom panels extending from said top and bottom edges of said front panel, respectively, wherein each of said top and bottom panels includes a first, wide end attached to said front panel and extends to a second, narrow end; and a tubular member having an top portion and a bottom portion, both of which include at least one hole formed transversely therethrough, wherein said top and bottom portions are spaced apart from said front panel and attached to said narrow, second ends of said top and bottom panels, respectively;

wherein said top portion of said tubular member is dimensioned to telescopically engage with said bottom portion of said tubular member such that said holes formed therethrough will be in alignment;

at least one linkage interconnecting the top panel of at least one of said modular units to the top panel of at least one of said laterally adjacent modular units; and at least one post interconnecting the top portion of said tubular member of at least one of said modular units to the bottom portion of a vertically adjacent modular unit.

6. The system of claim 5, wherein at least one said plurality of modular units includes a window frame pivotally mounted to said front panel that includes a transparent window positioned therein.

7. The system of claim 5, wherein at least one modular unit includes a pivotally mounted cover for selectively covering or expositing a port formed through the front panel of said at least one modular unit.

8. The system of claim 5, wherein at least one modular unit includes a platform extending perpendicularly from the bottom edge of the front panel of said at least one modular unit.

9. The system of claim 5, wherein each of said plurality of modular units further comprises a first plate spaced apart from said first panel and extending from one of said top and bottom edges of said front panel to overlap said front panel of said vertically adjacent positioned modular units.

10. The barrier of claim 5, wherein each of said plurality of modular units further comprises a second plate spaced apart from said first panel and extending from one of said side edges of said front panel to overlap said front panel of said horizontally adjacent modular units.

11. A kit for modular ballistic barrier system, comprising:

a plurality of modular units, each of which include a front panel defining a top edge, a bottom edge and two side edges; opposing top and bottom panels extending from said top and bottom edges of said front panel, respectively, wherein each of said top and bottom panels includes a first, wide end attached to said front panel and extends to a second, narrow end; and a tubular member having an top portion and a bottom portion, both of which include at least one hole formed transversely therethrough, wherein said top and bottom portions are spaced apart from said front panel and having a top portion associated with said top panel and bottom portion associated with said bottom panel and attached to said narrow, second ends of said top and bottom panels, respectively;

wherein said top portion of said tubular member is dimensioned to telescopically engage with said bottom portion of said tubular member such that said holes formed therethrough will be in alignment;

a plurality of linkages for interconnecting the top panel of at least one of said modular units to the top panel another of said modular units when positioned horizontally adjacent thereto; and a plurality of posts for interconnecting the top portion of said tubular member of one of said modular units to the bottom portion of another of said when positioned vertically adjacent thereto.

12. The kit of claim 11, wherein said plurality of said modular units includes at least one modular unit having a window frame pivotally mounted in said front panel and having a transparent window positioned therein.

13. The system of claim 11, wherein said plurality of said modular units includes at least one modular unit having a pivotally mounted cover for selectively covering or expositing a port formed through the front panel of said at least one modular unit.

14. The system of claim 11, wherein said plurality of said modular units includes at least one modular unit having a platform extending perpendicularly from the bottom edge of the front panel of said at least one modular unit.

* * * * *